US007053832B2

(12) United States Patent
Manzione et al.

(10) Patent No.: US 7,053,832 B2
(45) Date of Patent: May 30, 2006

(54) MULTIBAND ANTENNA ARRANGEMENT

(75) Inventors: Louis Thomas Manzione, Summit, NJ (US); Carsten Metz, Township Chatham, NJ (US); Richard Alan Warncke, Freehold, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 4 days.

(21) Appl. No.: 10/188,036

(22) Filed: Jul. 3, 2002

(65) Prior Publication Data

US 2004/0004579 A1 Jan. 8, 2004

(51) Int. Cl.
*H01Q 1/38* (2006.01)

(52) U.S. Cl. ..... 343/700 MS; 343/725; 343/727

(58) Field of Classification Search ..... 343/700 MS, 343/725, 727, 795, 797, 702, 846, 848, 793; H01Q 1/38, H01Q 21/00
See application file for complete search history.

(56) References Cited

U.S. PATENT DOCUMENTS 5,654,722 A * 8/1997 Lundback et al. ..... 343/725
6,091,365 A * 7/2000 Derneryd et al. .... 343/700 MS
6,239,750 B1 * 5/2001 Snygg ..... 343/700 MS
6,359,599 B1 * 3/2002 Apostolos ..... 343/895
6,426,723 B1 * 7/2002 Smith et al. ..... 343/700 MS
6,483,463 B1 * 11/2002 Kadambi et al. .... 343/700 MS
6,484,015 B1 * 11/2002 Aleiner et al. ..... 343/702
6,498,586 B1 * 12/2002 Pankinaho ..... 343/700 MS
6,795,020 B1 * 9/2004 Sreenivas et al. .... 343/700 MS
M

* cited by examiner

*Primary Examiner*—Hoanganh Le

(57) ABSTRACT

A multiple band antenna (and an array of such antennas) includes a first radiating element that radiates at a first band, at least one second radiating element that radiates at a second band, and a frame to hold the radiating elements. The frame disposes the first and second radiating elements in different planes so that cross-band interference is substantially avoided. Alternatively, a multiple band array antenna includes a first array of radiating elements in a first plane and a second array of radiating elements in a second plane. The first plane overlays the second plane. As a result, individual radiating elements in the first array are substantially interspersed with individual radiating elements in the second array. But the first array and the second array are arranged so that individual radiating elements in the first array substantially do not overlap individual radiating elements in the second array.

12 Claims, 12 Drawing Sheets

MULTIBAND ANTENNA ARRANGEMENT

BACKGROUND OF THE INVENTION

Broadband antennas, in general, are known. To a lesser extent, multiband antennas are known, in general. Typically, an array formed of broad band or multiband antennas cannot provide high gain efficiently, i.e., in terms of the volume consumed by the array itself.

The need for increased wireless communication system capacity continues to grow at a significant rate. To satisfy this need, some wireless service providers hope to use the higher frequency PCS band to provide the additional capacity. Hence, new antennas must be added to existing antenna towers or new antenna towers erected.

Unfortunately, most communities resist placing additional antennas on existing towers and/or erecting new antenna towers.

SUMMARY OF THE INVENTION

The invention, in part, is a recognition that an antenna for an additional wireless communication band can, in effect, be added to a tower (whose antenna quota has already been filled) by replacing a single band antenna with a multiband, e.g., dual-band antenna. This is especially advantageous if the ratios of the gain to the volume-consumed for the multiband antenna are at least comparable to the ratio of the antenna being replaced.

The invention, also in part, is a recognition that a multiband antenna can achieve ratios of gain to volume-consumed that are comparable to single band antennas if the radiating elements serving the different bands are nestled together, albeit in different array planes, and can achieve good performance if the radiating elements are arranged to so as to not induce cross-band interference.

Accordingly, an embodiment of the invention provides a multiple band antenna that includes a first radiating element that radiates at a first band, at least one second radiating element that radiates at a second band, and a frame to hold the radiating elements. The frame disposes the first and second radiating elements in different planes. Consequently, cross-band interference may be substantially avoided. The first band, e.g., may be lower than the second band.

Another embodiment of the invention provides an antenna arrangement that includes an array of antenna structures. Each antenna structure includes the first radiating element, the one or more second radiating elements and the frame to hold the radiating elements.

Another embodiment of the invention provides a multiple band array antenna that includes a first array of radiating elements in a first plane and a second array of radiating elements in a second plane. The first plane overlays the second plane. As a result, individual radiating elements in the first array are substantially interspersed with individual radiating elements in the second array. But the first array and the second array are arranged so that individual radiating elements in the first array substantially do not overlap individual radiating elements in the second array.

The invention may be embodied in other forms without departing from its spirit and essential characteristics. The described embodiments are to be considered only non-limiting examples of the invention. The scope of the invention is to be measured by the appended claims. All changes which come within the meaning and equivalency of the claims are to be embraced within their scope.

BRIEF DESCRIPTION OF THE DRAWINGS

The accompanying drawings are: intended to depict example embodiments of the invention and should not be interpreted to limit the scope thereof; and not to be considered as drawn to scale unless explicitly noted.

DETAILED DESCRIPTION OF EXAMPLE EMBODIMENTS

Figure 1A:
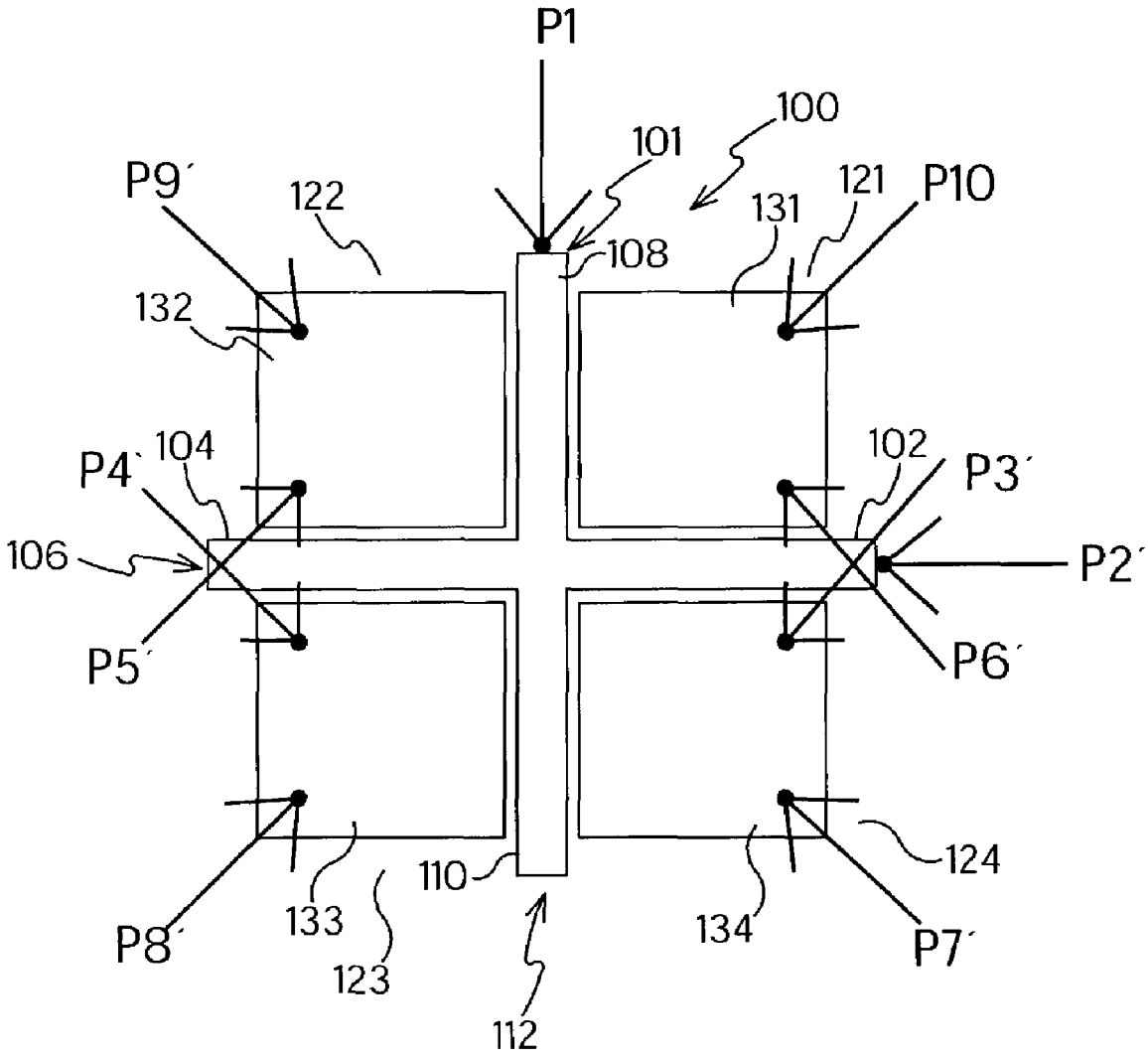
FIG. 1A is a top view of a cross antenna arrangement according to an embodiment of the invention.

FIG. 1A is a top view of a populated rectangular cross arrangement 100 according to an embodiment of the invention. The arrangement, or structure, 100 includes: a cross-shaped radiating element 101; and rectangular, e.g., square, patch-type radiating elements 131, 132, 133 and 134. The elements 101 and 131–134 are metallic, e.g. aluminum. The choice of the thickness for the elements 101 and 131–134 is a well known design exercise. An advantage of the cross-shape is that blocking of the line of sight to the square radiating elements aligned with its quadrants can be avoided.

The cross element 101 includes a right arm 102 and a left arm 104 that together define a horizontal span 106, plus a top arm 108 and a bottom arm 110 that together define a vertical span 112. The cross element 101 is analogous to a two-dimensional Cartesian plane in which the right arm 102 corresponds to the positive X-axis while the top arm 108 corresponds to the positive Y-axis. As such, the cross element 101 can be understood to define first through fourth quadrants 121, 122, 123, and 124, respectively. The cross 101 is located in a first plane and the elements 131–134 are located in a different second plane, spaced sufficiently far apart to significantly reduce interference.

Figure 1B:
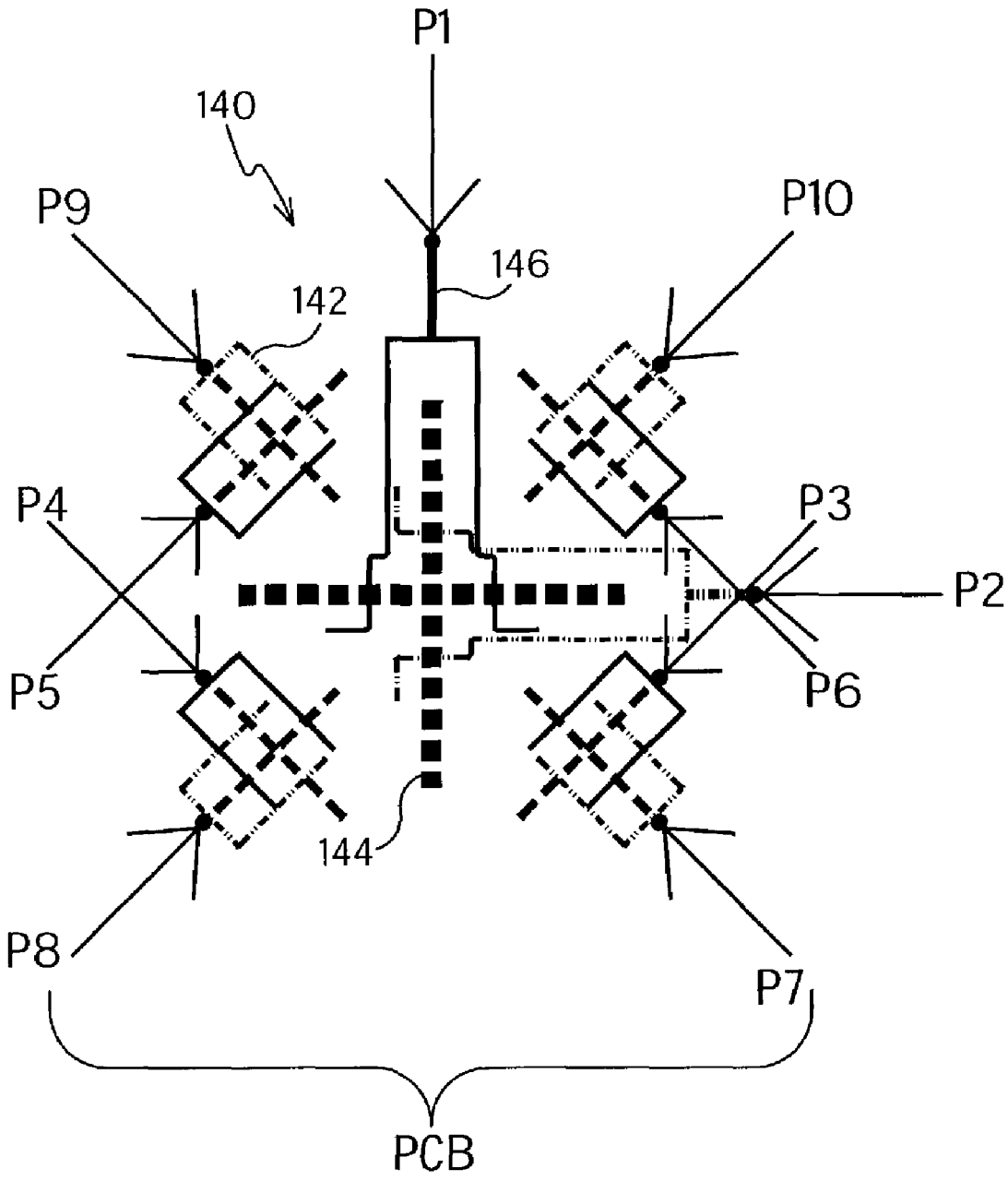
FIG. 1B is a top view of a feeder network according to an embodiment of the invention for use with the antenna arrangement of FIG. 1A.

FIG. 1A also indicates alignment points P1', P2', P3', . . . P9' and P10' corresponding to feed input points of a corresponding feeder network, as illustrated in FIG. 1B. FIG. 1B is a top view of an example feeder network 140 according to an embodiment of the invention for use with the structure 100 of FIG. 1A. Three layers of conductors are superimposed in the top view that is FIG. 1B.

Figure 1C:
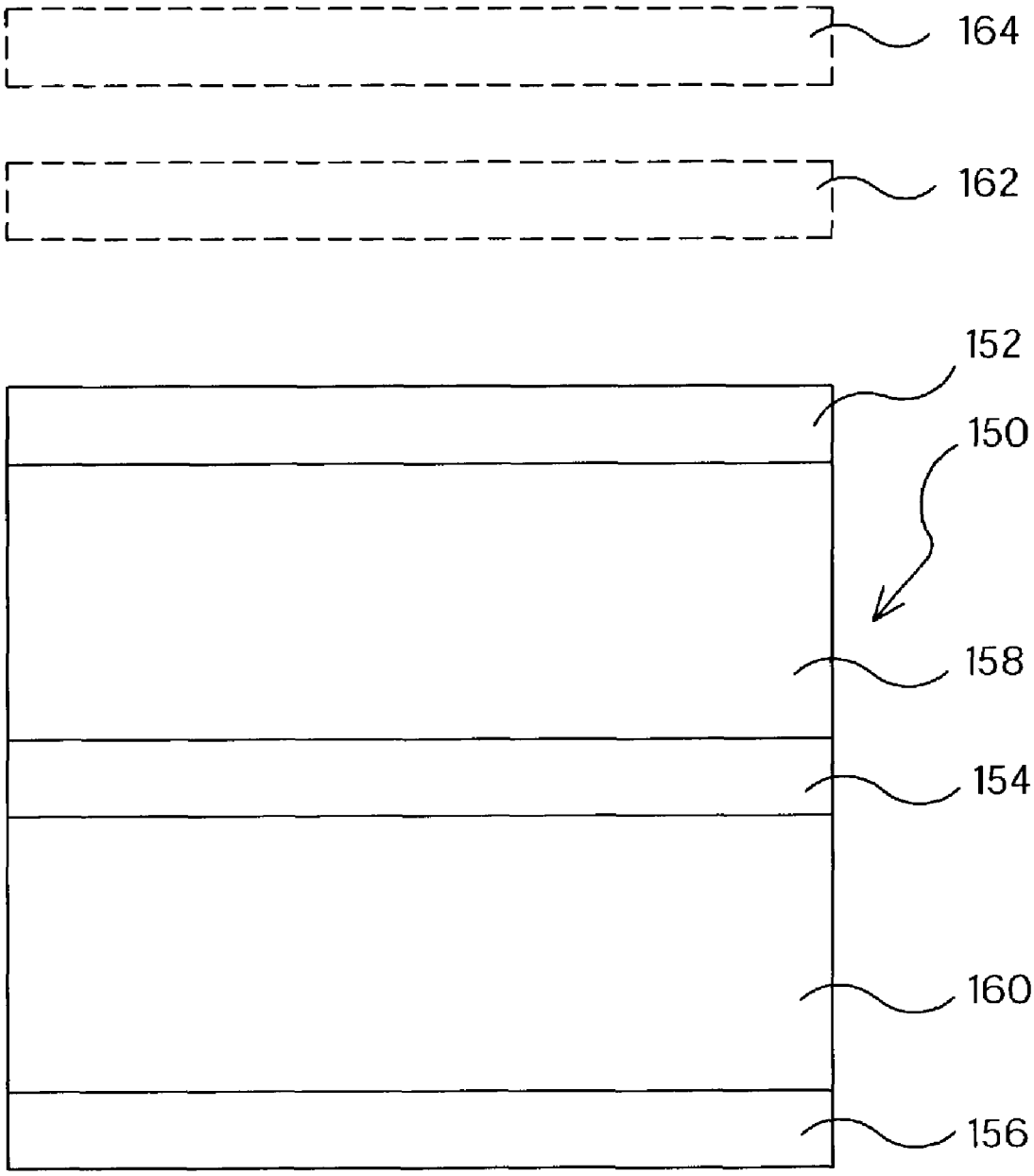
FIG. 1C is a side view of a printed circuit board according to an embodiment of the invention for use with the feeder network of FIG. 1B.

FIG. 1C is a side view of a printed circuit board (PCB) 150 according to an embodiment of the invention corresponding to the feeder network 140 of FIG. 1B. In FIG. 1C, a low dielectric insulating layer 160 is interposed between a bottom conductive layer 156 and an intermediate conductive layer 154 (e.g., a ground plane). A low dielectric insulating layer 158 is interposed between a top conductive layer 152 and the intermediate conductive layer 154. A layer 162 corresponding to the plane of the square radiating elements 131–134 is shown above the top conductive layer 152. A layer 164 corresponding to the plane of the cross element 101 is shown above the layer 162.

The bottom conductive layer 156 corresponds to the patterned conductive runs 146 in FIG. 1B. The intermediate conductive layer 154 corresponds to the cross-shaped slots in a conductive ground plane 154 in FIG. 1B, i.e., slot radiators 144. And the top conductive layer 152 corresponds to the patterned conductive runs 142 in FIG. 1B.

FIG. 1B also includes feed inputs P1, P2, P3, . . . P9 and P10. The feeder network 140 is positioned beneath the structure 100 and is aligned as follows: Point P1' of FIG. 1A aligns with point P1 of FIG. 1B; Point P2' of FIG. 1A aligns with point P2 of FIG. 1B; Point P3' of FIG. 1A is aligned with point P3 of FIG. 1B; Point P9' of FIG. 1A is aligned over point P9 of FIG. 1B; and Point P10' of FIG. 1A is aligned over point P10 of FIG. 1B.

The square radiating elements 131–134 are positioned in a plane lying a predetermined distance above the plane of the top conductive layer 152 of the PCB 150. The plane of the cross element 101 is positioned a second predetermined distance, greater than the first predetermined distance, above the layer 152 of the PCB 150. Alternatively, the cross element 101 could be located closer to the PCB 150 than the square elements 131–134. In general, the distance of a radiating element to the feeder network is determined according to the bandwidth over which the radiating element radiates.

In operation, the electromagnetic signals provided to the feed inputs P1–P10 of the feeder network 140 cause the feeder network 140 to excite the slot radiators 144. The electromagnetic radiation from the slot radiators 144 couples electromagnetically with the structure 100 aligned over it such that the structure 100 radiates electromagnetically. There are no galvanic couplings between the feeding network and the associated cross-shaped radiating elements and squared-shaped radiating elements. The electromagnetic radiation of the structure 100 produces a beam shape that is highly amenable to beam forming and beam steering. In addition, the beam formed by the structure 100 exhibits a very good efficiency ratio both in terms of input to output power, and output power to volume consumed by the structure.

As is well known, once the shape of the radiating arrangement is determined, e.g., the structure 100, an ordinary (or lesser) amount of experimentation is required to determine an appropriate feeder network. An example of commercially available software that can determine an appropriate corresponding feeder network (and also model appropriate dimensions and spacing of a radiating arrangement) is the ADVANCED DESIGN SYSTEM brand of modeling software made available by AGILENT TECHNOLOGIES INC.

The structure 100 of FIG. 1A can be described as a populated cross arrangement because there is at least one square radiating element, e.g., 131, that is aligned with one of the quadrants 121–124. In other words the structure 100 should have at least one of the quadrants 121–124 populated in order for the structure 100 to be dual-band. Populating each of the other three quadrants is optional. Another embodiment of the structure 100 has two square radiating elements, e.g., 131 and 134.

The cross element can be a low frequency radiator while the small squares are high frequency radiators. Generally, the frequency of the cross, $F_C$, is about ½ the frequency of the squares, $F_S$, i.e., $F_C \approx ½ F_S$.

Alternatively, elements 131 and 132 can be designed and energized to radiate at a second frequency, $f_2$, (relative to the first frequency, $f_1$, of the element 110). And elements 133 and 134 can be designed and energized to radiate at a third frequency, $f_3$. This produces a tri-band structure. The relative relationships can be $f_1<f_2$ and $f_1<f_3$.

More generally in the alternative, the elements 131–134 can be designed and energized to each radiate at a different frequency. It is noted that incorporating such a five-band structure into an array can be more difficult to implement than the dual-band structure or the tri-band structure because it is more difficult for elements energized with the same frequency to be adjacent. In other words, it is more difficult to achieve acceptable C2C distances between elements energized with the same frequency signals for an array of five-band structures.

The cross-shaped radiating element can radiate or receive two polarizations. The first one of the polarizations is parallel to a first one of the arms of the cross. The second one of the polarizations is parallel to a second one of the arms of the cross.

The polarization of the electromagnetic radiation from or received by the squares can be +/−45°, i.e., parallel to a diagonal line that bisects the squares that are in opposite quadrants of the cross element to which the squares are aligned. In other words, the line bisecting the first and third quadrant represents the line to which a first polarization of the squares is parallel. The line bisecting the second and fourth quadrants represents a line to which the second polarization of the squares is parallel. Alternatively, the feeder network can be adapted to horizontally and vertically polarize radiation from the squares instead of inducing +/−45° polarization.

Such polarization permits a single antenna to act as multiple antennas, which, e.g., can be beneficial in terms of diversity. For example, where the cross-shaped radiating element exhibits dual polarization and the squares also exhibit dual polarization, such nestled radiating elements act as four separate antennas.

Figure 2:
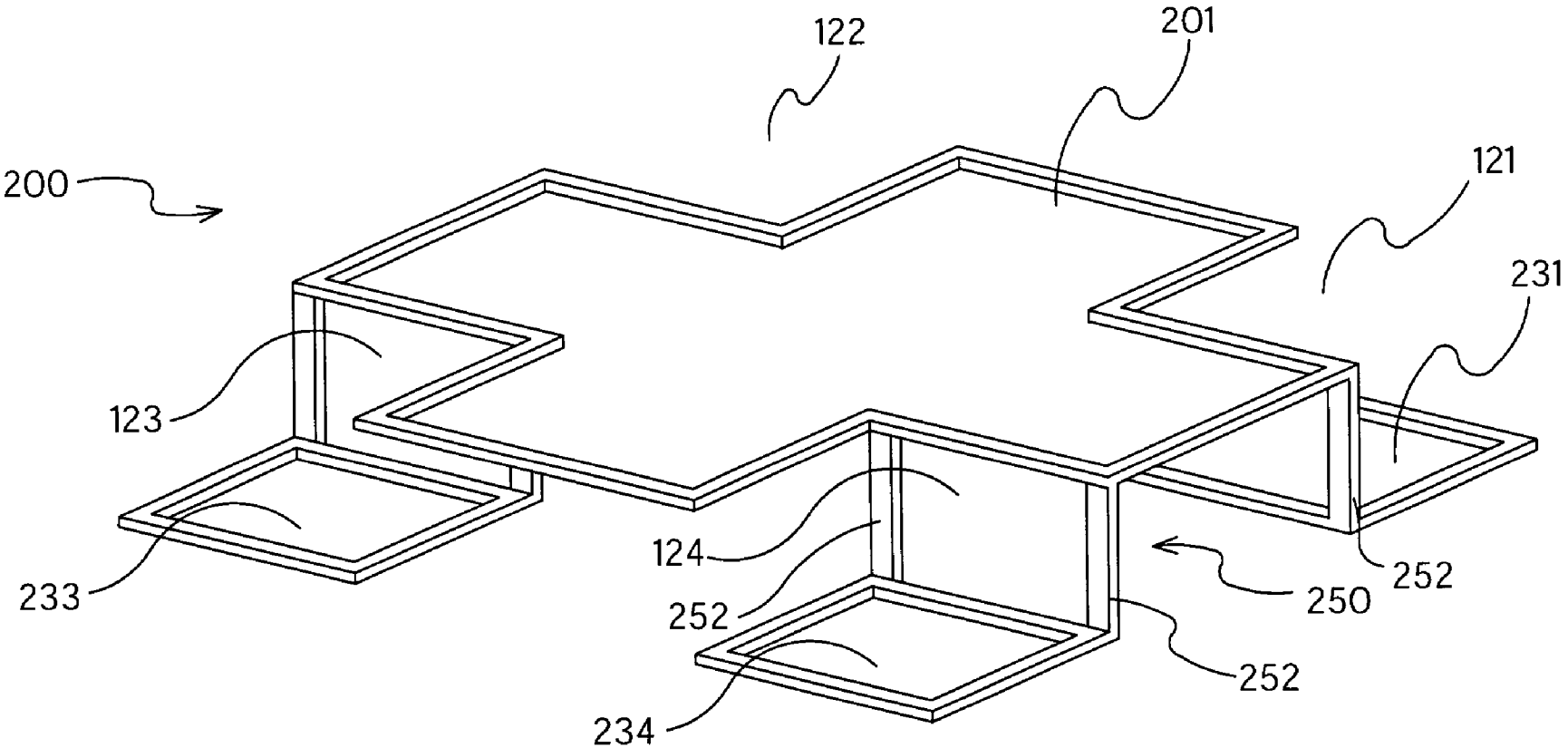
FIG. 2 is a three-quarter perspective view of a cross antenna arrangement according to an embodiment of the invention.

FIG. 2 is a three-quarter perspective view of a populated cross structure 200 according to an embodiment of the invention. The structure 200 includes a radiating cross element 201 that is rectangular, i.e., it is formed of intersecting rectangles having substantially the same width and substantially the same length. The structure 200 includes rectangular, e.g., square, radiating elements 231, 232 (not depicted in FIG. 2 because it is obscured by the cross element 201), 233, and 234. As before, the square radiating elements 231–234 are aligned with the quadrants 121–124, respectively.

To maintain the cross element 201 in a plane above and parallel to the plane of the square radiating elements 231–234, a frame 250 is provided. The frame 250 has legs 252 that are substantially perpendicular to the planes of the cross element 201 and the square radiating element 231–234.

Figure 3:
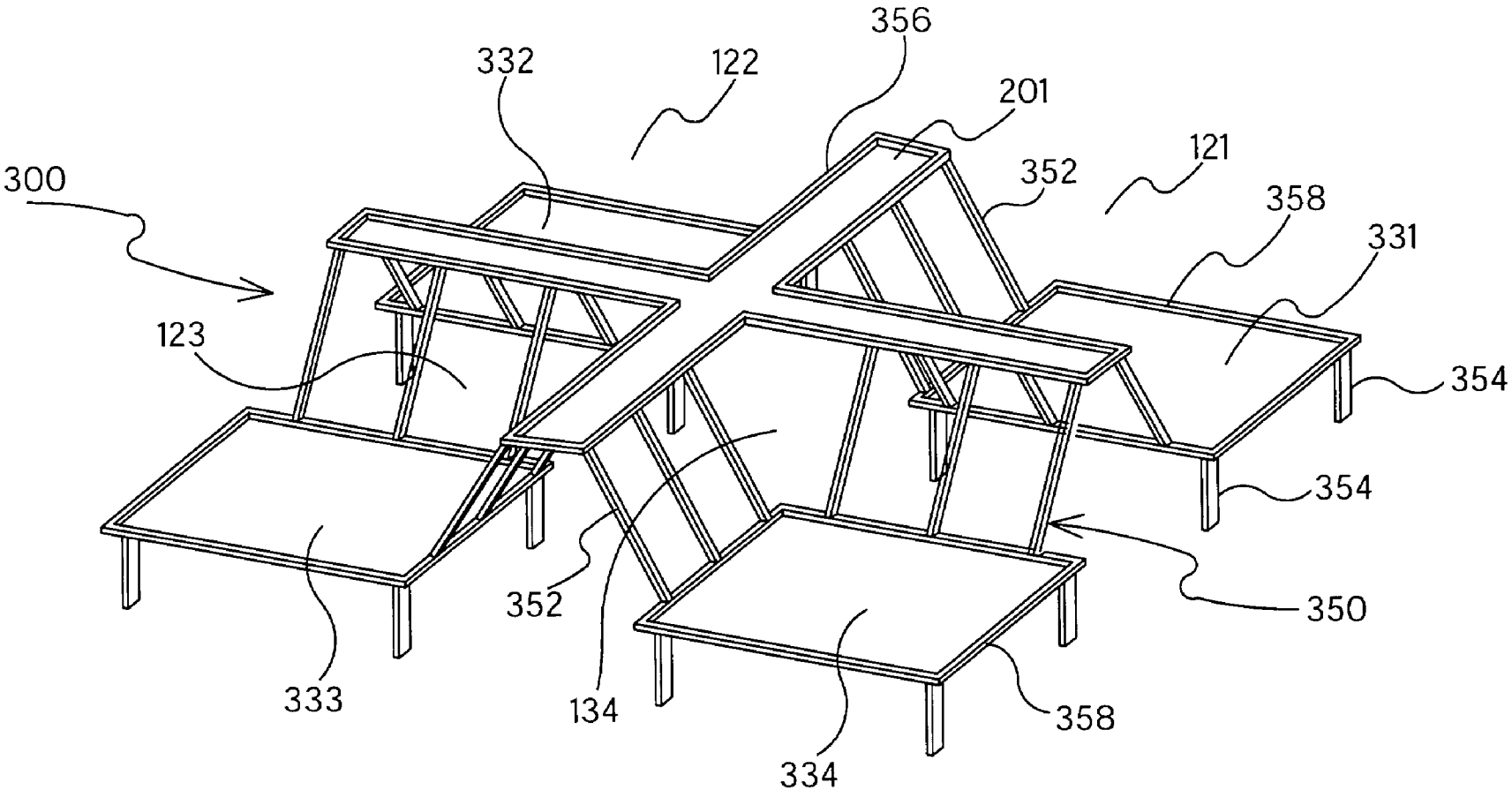
FIG. 3 is a three-quarter perspective view of a cross antenna arrangement according to an embodiment of the invention.

FIG. 3 is a three-quarter perspective view of a populated cross arrangement, or structure, 300 according to an embodiment of the invention. FIG. 3 is similar to FIG. 2 except (primarily) that the frame 350 has legs 352 that extend downward from the plane of the cross element 201 at a non-perpendicular angle, e.g., approximately 60° (thereby intersecting the plane of the square radiating elements 331–334 at an approximately 60° angle).

In addition, the frame 350 has a cross-shaped receptacle 356 that is rimmed so that the cross element 201 fits snugly into the recess. Similarly, the frame 350 has four rimmed receptacles 358 arranged so that the square radiating elements 331–334 fit snugly in the recesses, respectively. The radiating elements can be held in the receptacles by, e.g., a friction fit.

The frame 350 includes legs 354 that establish the predetermined spacing between the PCB, e.g., 150, and the plane of the square radiating elements 331. The legs 352 establish the proper spacing between the plane of the cross element 201 and the square radiating elements 331–334.

Both the frames 250 and 350 should be made of non-conductive material, e.g., plastic. Such a plastic frame can be injection molded. An advantage of the angled legs 352 of the frame 350 relative to the perpendicular legs 252 of the frame 250 is that the angled legs 352 can be easier to form from the perspective of doing the injection molding.

Figure 4:
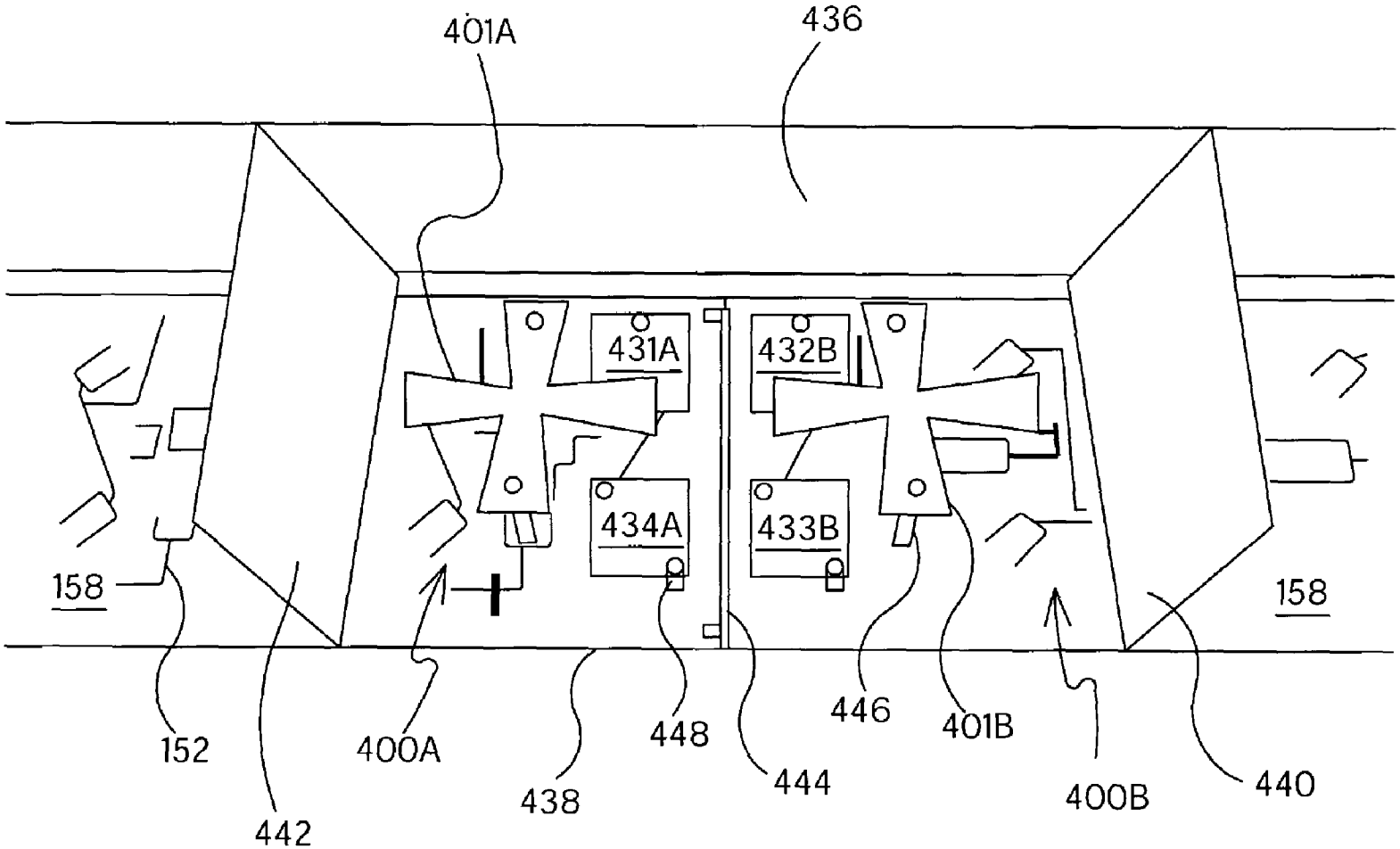
FIG. 4 is a three-quarter perspective view of a building block antenna arrangement according to an embodiment of the invention.

FIG. 4 is a three-quarter view of a populated cross arrangement according to an embodiment of the invention.

The arrangement of FIG. 4 includes two populated cross arrangements, or structures, 400A and 400B. Each of the structures 400A and 400B includes a cross-shaped element 401A and 401B, respectively. In contrast to the radiating crosses of FIGS. 1A–3, the crosses 401A and 401B are bowtie-shaped crosses rather than rectangular crosses. It has been empirically shown that the bow tie cross shape has a broader bandwidth than the rectangular cross shape. Tests of an example rectangular cross-based building block versus a bow tie-based building block revealed that the rectangular cross bandwidth is about 140 MHz while the bandwidth of the bow tie cross was about 280 MHz.

The structure 400A includes a radiating element 431A and a radiating element 433B that are aligned with the first and fourth quadrants of the cross element 401A. Similarly, the structure 400B includes rectangular, e.g., square, radiating elements 432B and 433B that are aligned with the second and third quadrants of the cross element 401B.

The radiating crosses 401A and 401B are located in substantially the same plane. The radiating squares 431A, 434A, 432B and 433B are located in substantially the same plane, which is below the plane of the radiating crosses 401A and 401B. The radiating crosses 401A and 401B are elevated above the PCB 158 by non-conductive posts 446. The square radiating elements 431A, 434A, 432B and 433B are elevated above the PCB 158 by non-conductive posts 448. The use of such non-conductive posts is an alternative to the plastic frames 250 and 350. In a situation in which ease of installation of the radiating elements and minimization of the cost of the spacing materials is important, the non-conductive frame approach, e.g., 250 or 350, would be preferable to the use of the posts 446 and 448.

The radiating arrangement of FIG. 4 that includes the structures 400A and 400B defines a building block which can be repeated to produce an antenna array.

The building block of FIG. 4 can also include a top wall 436, a bottom wall 438 (partially removed in FIG. 4 to improve the view), a right wall 440, a left wall 442 and a center wall 444 extending to the same side of the PCB 158 as the radiating elements.

An example of sizes and spacing for the building block depicted in FIG. 4 will now be provided. In the example, the square radiating elements 431A, 434A, 432B and 433B are designed to radiate in the range 1.85 GHz–1.99 GHz, i.e., the PCS band in the United States. The crosses 41A and 41B are designed to radiate at a frequency range of 816–894 MHz, and as such are operable both in the cellular band and the SMR band. The squares 431A, 434A, 432B and 433B are positioned 12 mm above the PCB 158 while the crosses 401A and 401B are positioned 48 mm above the PCB 158.

Continuing the example, the center-to-center ("C2C") distance between the square 431A and the square 432B, as well as between the square 434A and square 433B can be 78 mm, which corresponds to 0.5λ in the PCS band. The C2C distance between the squares 431A and 434A, as well as between the squares 432B and 433B, is 105 mm, which corresponds to 0.67λ in the PCS band. The squares 431A, 434A, 432B and 433B have sides that are 55 mm, which corresponds to 0.35λ in the PCS band.

Further continuing the example, each of the spans (namely from the left arm to the right arm, and from the top arm to the bottom arm) of the crosses 401A and 401B is 130 mm. At its most narrow part, an arm of a cross is 13 mm wide. At its widest part, i.e., at the ends of the arms, the arms are 32 mm wide. From the center of the crosses, the arms widen out at an angle of approximately 30°. The C2C distance between the crosses 41A and 41B is 190 mm which corresponds to 0.54λ in the cellular band.

Further continuing the example, from the center of the upper squares 431A and 432B to the top wall 436 is 64 mm, which corresponds to 0.41λ in the PCS band. From the center of each of the squares 431A, 434A, 432B and 433B to the center wall is 39 mm, which corresponds to 0.25λ in the PCS band. The center of the lower squares 434A and 433B to the bottom wall 438 is correspondingly the same, namely 64 mm, which corresponds to 0.41λ in the PCS band. From the center of the squares 431A and 434A to the left wall 442, and from the center of the squares 432B and 433B to the right wall 440, is 150 mm, which corresponds to 0.96λ in the cellular band. From the top wall 436 to the bottom wall 438 is 216 mm.

Further continuing the example, the left and right walls 442 and 440 are 4.72 inches in width, i.e., from the side edge touching the PCB to the opposite side edge. The height of the center wall 444 is 55 mm, which corresponds to 0.35λ in the PCS band. The left and right walls 442 and 440 are inclined at an angle of 68° with respect to the portion of the plane of the PCB 158 that is on the opposite of the walls relative to where the radiating elements are located. The width of the top wall 436 and the bottom wall 438 (again, partially shown in FIG. 4 for simplicity of the view) is 4.72 inches. The top and bottom walls 436 and 438 are inclined away from the radiating elements at an angle of 60° with respect to the portion of the plane of the PCB 158 that is on the opposite side of the top and bottom walls 436 and 438 as the radiating elements.

The plane of the PCB 158 can be, e.g., vertical. Alternatively, the plane of the PCB 158 can be inclined to about 5° relative to vertical in order to achieve mechanical down lift.

Figure 5:
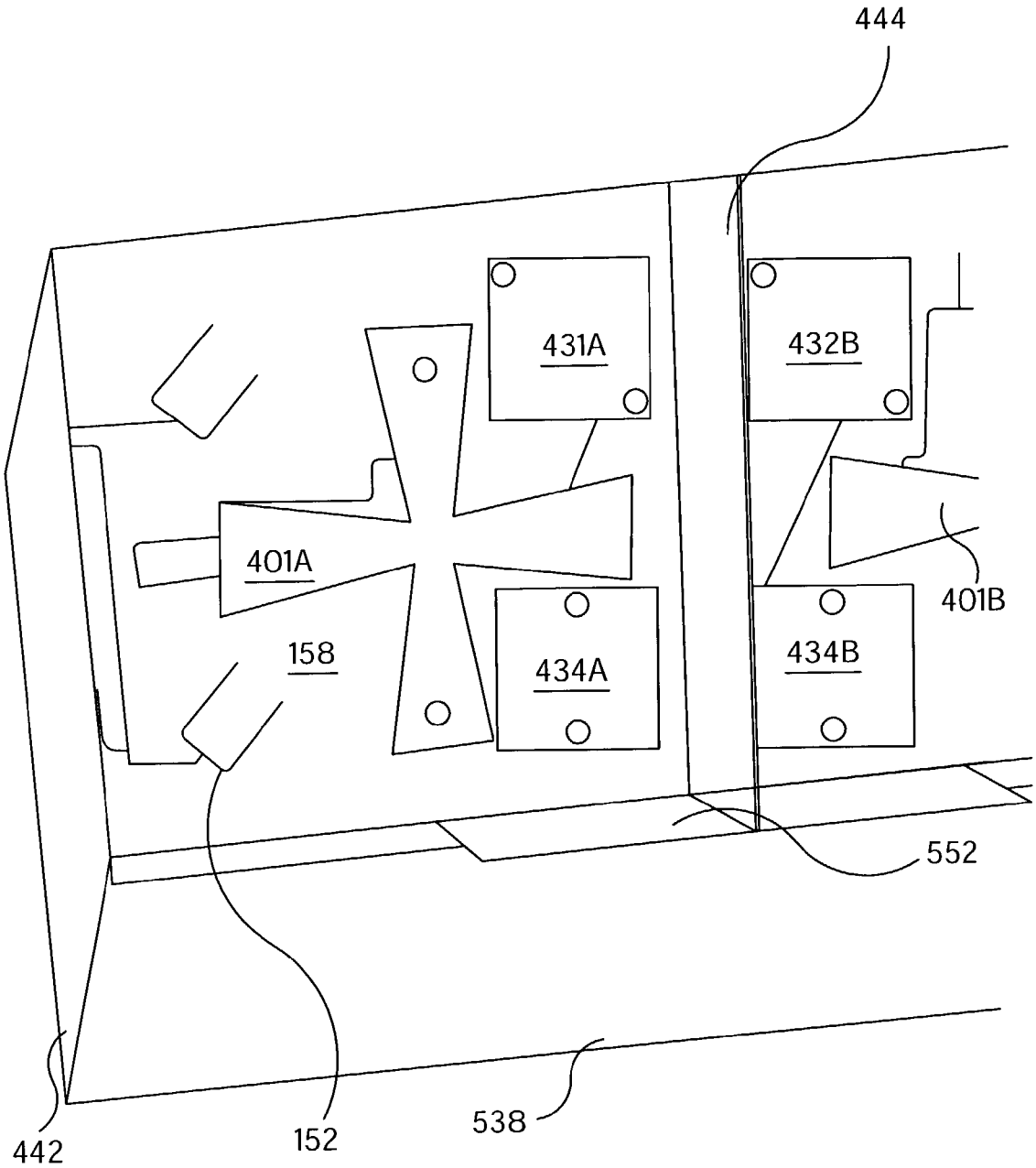
FIG. 5 is a three-quarter perspective view of a portion of a building block antenna arrangement according to an embodiment of the invention.

FIG. 5 is a three-quarter perspective partial view of a populated cross antenna building block according to an embodiment of the invention. The embodiment of FIG. 5 is very similar to the embodiment of FIG. 4. But it is to be noted that the embodiment of FIG. 5 includes an extra bottom wall 552 and correspondingly arranged and sized extra top wall (not shown). The additional bottom wall 552 extends from the center wall to the midline of the vertical span of the cross 401A and is substantially the same height as the center wall 444. The additional bottom wall 552 extends in a normal direction from the plane of the PCB 158. Like the side walls of FIG. 4, the additional top wall (not depicted) and bottom wall 552 are optional. The sizing and orientation of the top wall (not depicted) is substantially the same as that of the bottom wall 552.

Figure 6:
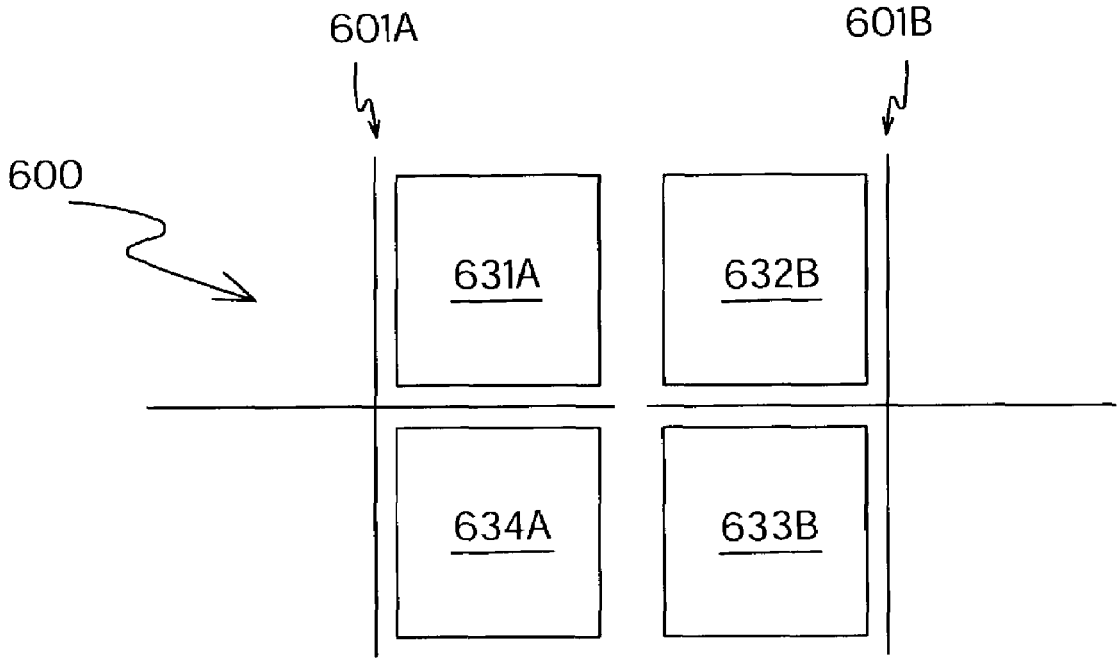
FIG. 6 is a simplified top view of an array building block antenna arrangement according to an embodiment of the invention.

FIG. 6 is a simplified top view of a building block 600 for use in an antenna array according to an embodiment of the invention. The building block 600 includes a first radiating cross-shaped element 601A and a second radiating cross-shaped element 601B. The building block 600 is a simplified depiction of the building block depicted in FIG. 4. The building block 600 includes four rectangular, e.g., square radiating elements 631A, 634A, 632B and 633B. The element 631A is aligned with the first quadrant of the cross 601A while the element 634A is aligned with the fourth quadrant of the cross 601A. The elements 632B and 633B are aligned with the second and third quadrants of the cross 601B. As in the other embodiments, the crosses 601A and 601B are located in substantially the same plane while the square elements 631A, 634A, 632B and 633B are located in substantially the same plane below the plane having the crosses 601A and 601B.

Figure 7:
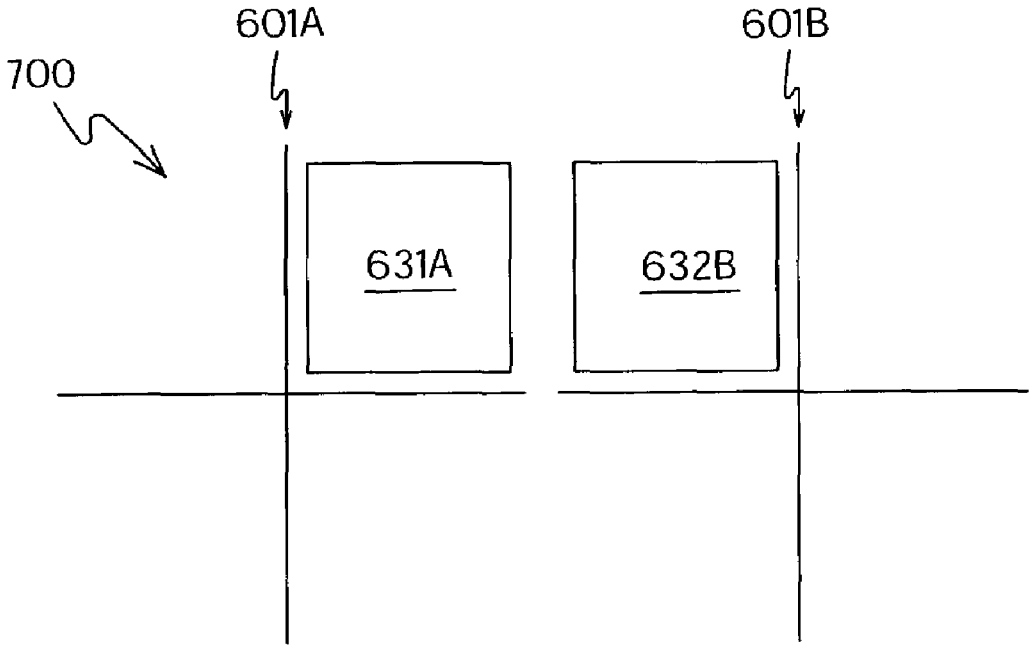
FIG. 7 is a top view of an array building block antenna arrangement according to an embodiment of the invention.

FIG. 7 is a top view of a simplified building block for an array antenna according to an embodiment of the invention. The building block 700 is a reduced version of the building block 600, i.e., the elements 634A and 633B have been deleted. Otherwise, the building block 700 is substantially the same as the building block 600.

As to the building block 600, optional square radiating elements can be aligned with the second and third quadrants of the first cross 601A and the first and fourth quadrants of the second cross 601B. If a radiating element is added to the second quadrant of the first cross 601A, then a corresponding radiating element should be added to the first quadrant of the cross 601B. Similarly, if a radiating element is added to the third quadrant of the cross 601A, then a radiating element should be added to the fourth quadrant of the second cross 601B, etc.

In general, for the structures of FIGS. 1A, 6 and 7, radiating elements of similar shape should be separated by an amount in the range of about $\lambda$ to about $\frac{1}{2}\lambda$.

Figure 8:
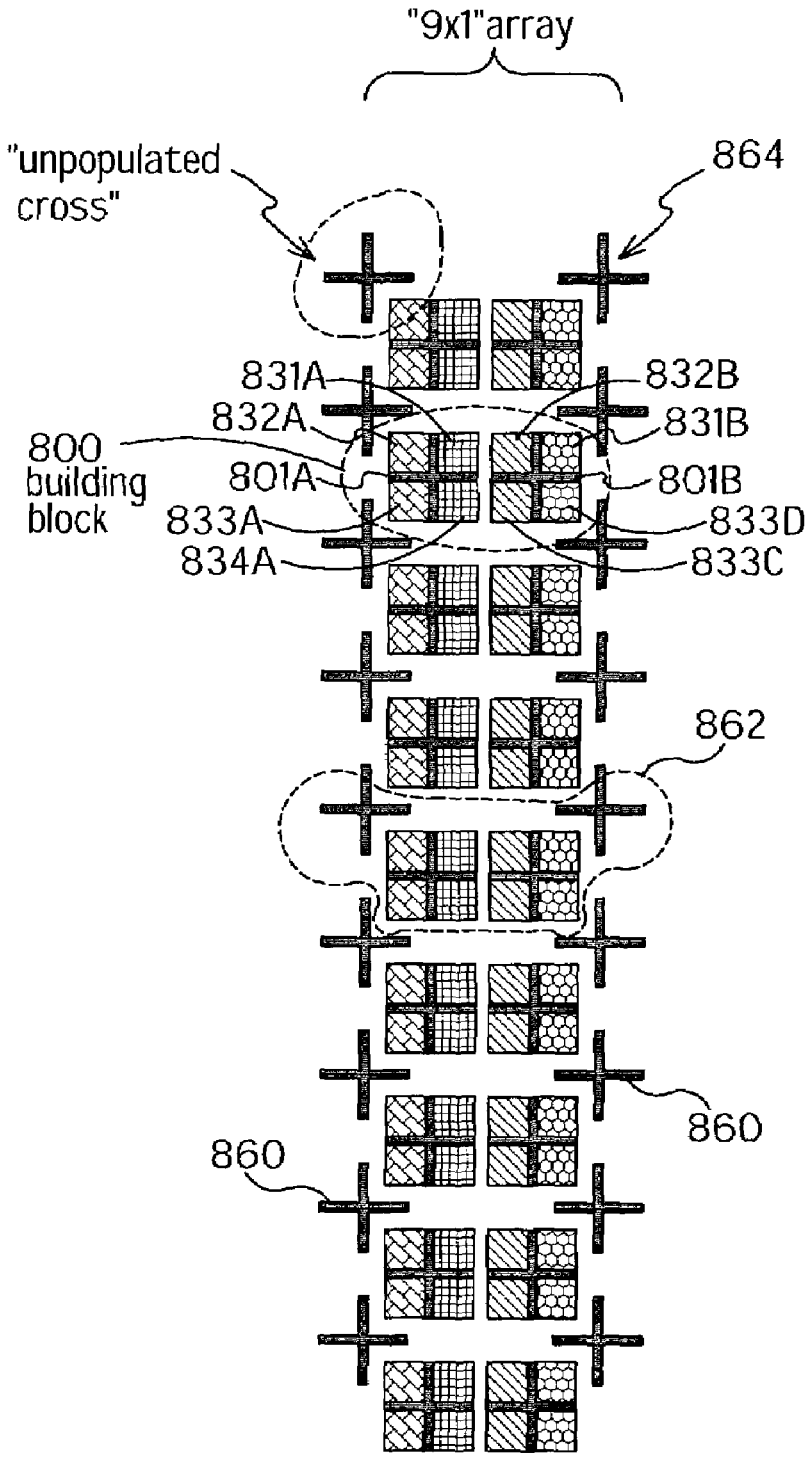
FIG. 8 is a top view of an antenna array according to an embodiment of the invention.

FIG. 8 is a top view of an antenna array 864 according to an embodiment of the invention. The array 864 has a micro building block 800 that is similar to the building block 600 in the circumstance in which all of the quadrants of the radiating crosses 801A and 801B are populated. Radiating square elements 831A, 832A, 833A and 834A are aligned with the quadrants of the cross 801A. Square radiating elements 831B, 832B, 833C and 833D are aligned with the quadrants of the cross 801B. As an example, if the example of FIG. 4 was adopted as the building block 800, the vertical C2C distance between corresponding radiating squares, e.g., 832B of a lower row and 833C of an upper row, would be about $0.8\lambda$ in the PCS band.

In the array 864, a row corresponds to a building block 800. For example, the array 864 is 9×1, i.e., nine rows by one column.

Also present in the array 864 are unpopulated crosses 860. An unpopulated cross substantially has no radiating elements aligned with its quadrants. Each building block 800 has two unpopulated crosses 860 associated with it. The first such unpopulated cross sits adjacent to the element 831B along a line that bisects the radiating elements 831B and 833C. Similarly, the second radiating element sits adjacent to the radiating element 832A along a line that bisects the elements 832A and 834A. The building block 800 and its associated unpopulated crosses 860 can be considered a macro building block 862. There are nine macro building blocks 862 depicted in the array 864.

Figure 9:
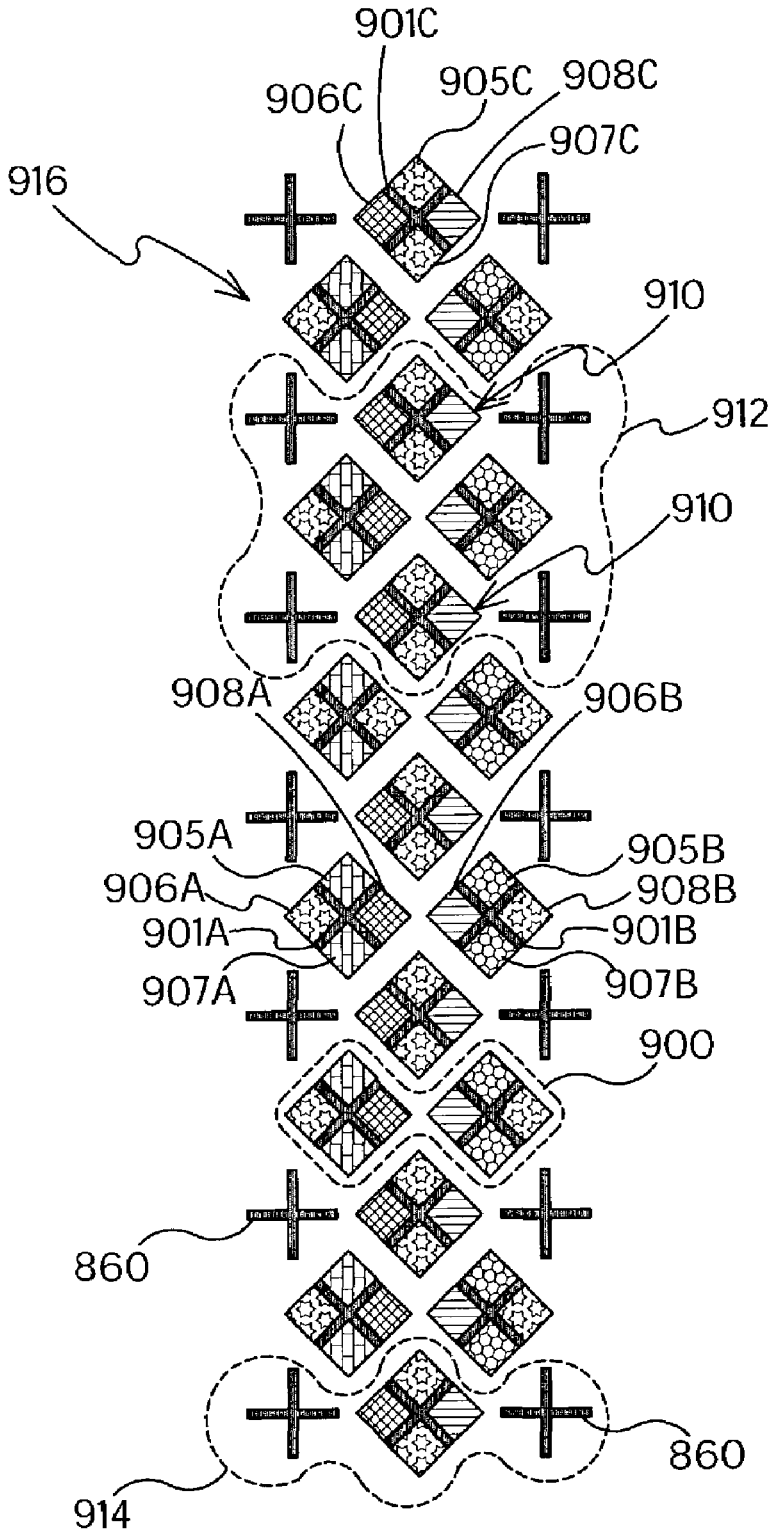
FIG. 9 is a top view of an antenna array according to an embodiment of the invention.

FIG. 9 depicts a top view of an antenna array 916 according to an embodiment of the invention. The basic building block 900 of FIG. 9 is somewhat similar to the building block 800 of FIG. 8. The crosses 901A and 901B are rotated 45° relative to the crosses 801A and 801B. Radiating elements 905A, 906A, 907A and 908A are aligned with the first through fourth quadrants of the cross 901A. Radiating elements 905B, 906B, 907B and 908B are aligned with the first through fourth quadrants of the cross 901B. The crosses 901 and 901B are arranged so that substantially the same line bisects the squares 906A, 908A, 906B and 908B.

The array 916 has nearly the same arrangement of unpopulated crosses as the array 864, except that an additional two unpopulated 860 are included at the bottom of the array 916. In addition, each pair of horizontally-adjacent crosses 860 has a populated cross 901C located between them. The cross 901C has the same rotational orientation as the crosses 901A and 901B. Radiating elements 905C, 906C, 907C and 908C are aligned with the first through fourth quadrants of the cross 901C. A macro-block 912 in FIG. 9 includes a micro-block 900 and a combination 914 (of unpopulated crosses 860 and a populated cross 901C) above and a combination 914 below. As such, the array 916 has six macro-blocks 912 if one adopts the interpretation that adjacent macro-blocks 912 share a combination 914.

Figure 10:
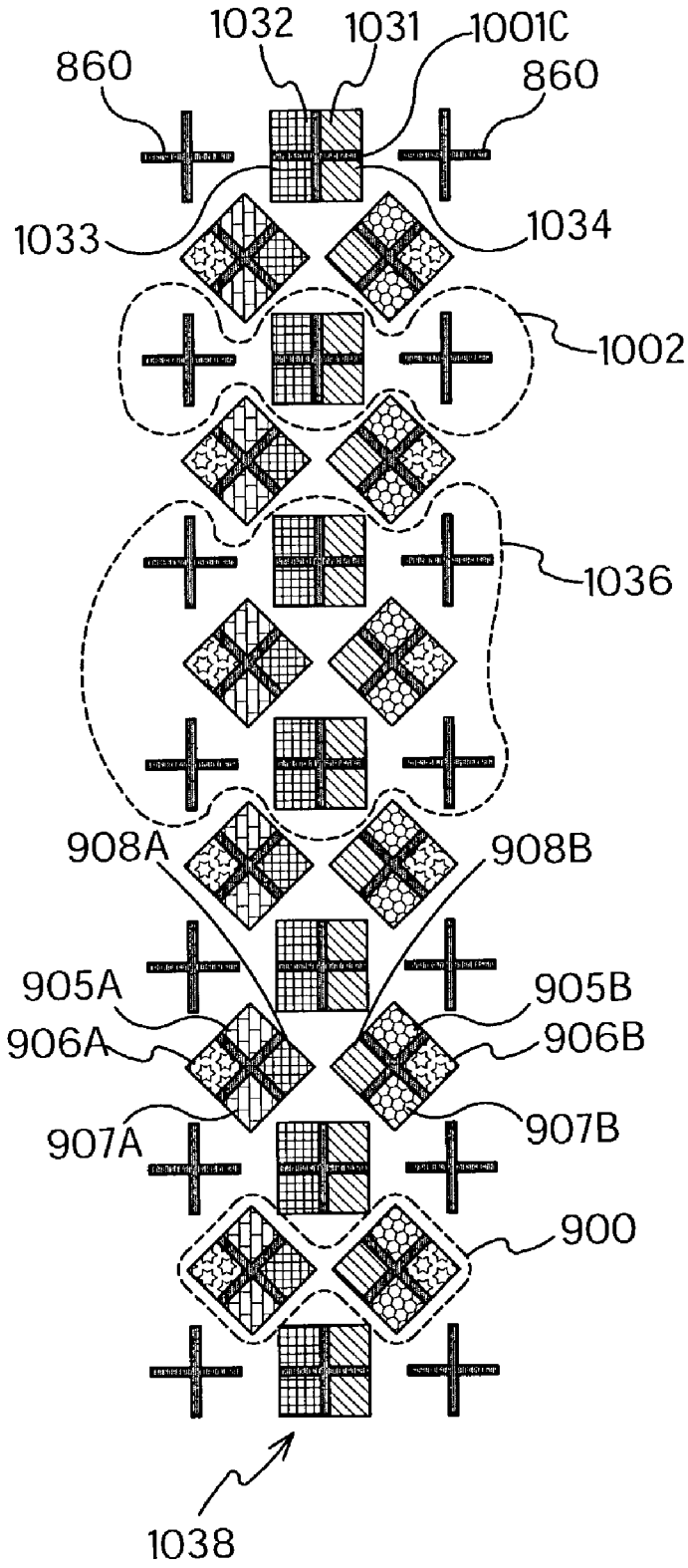
FIG. 10 is a top view of an antenna array according to an embodiment of the invention.

FIG. 10 depicts an antenna array 1038 according an embodiment of the invention. The array 1038 is similar to the array 916 in that both use the same micro-block 900. The array 1038 has a combination 1002 that is similar to the combination 914 except that it includes a populated cross 1001C rather than a populated cross 901C. The populated cross 1001C has the same rotational orientation as the populated crosses 801A and 801B. The array 1038 has a macro-block 136 that is similar to the macro-block 912 of FIG. 9.

Beam formation and steering for each of the arrays 864, 916 and 1038 for the higher frequency of the square radiating element is controlled by keeping the frequency and amplitude the same but varying the phase of the signals fed to the respective square radiating elements. For example, in FIG. 8, the signal fed to the square elements 832B will be different in phase than the signal fed to the square elements 831A, etc.

The array 916 has square radiating elements whose C2C distance is greater than, e.g., the square elements of the array 864. Hence, the array 916 has a reduced ability to steer relative to the array 864.

Figure 11C:
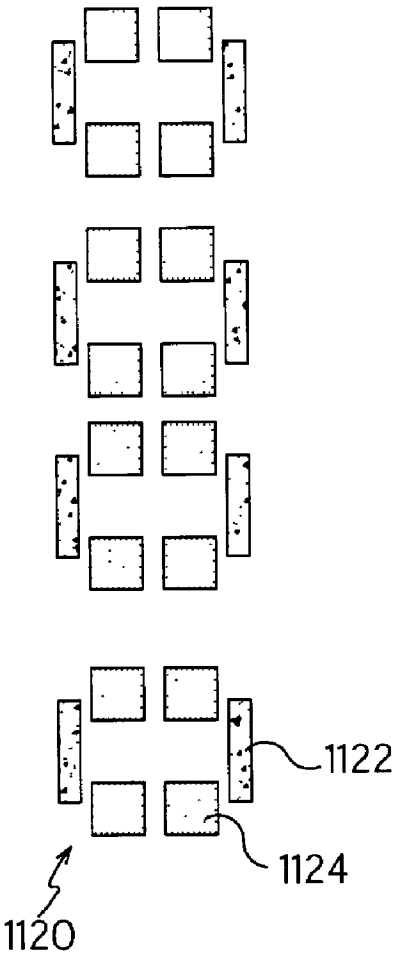
FIGS. 11A–11C are top views of antenna arrays according to other embodiments of the invention.
Figure 11B:
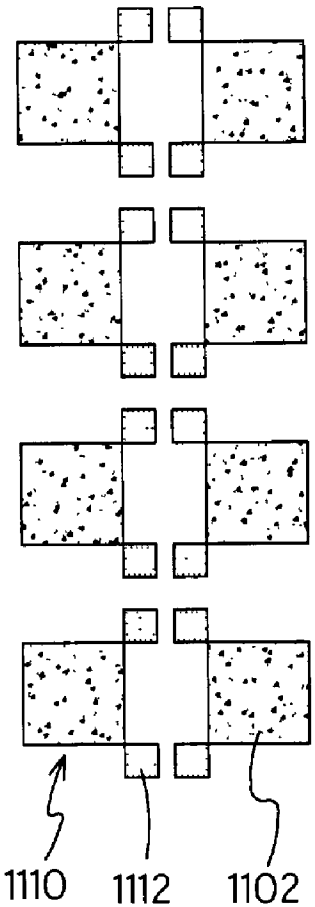
Figure 11A:
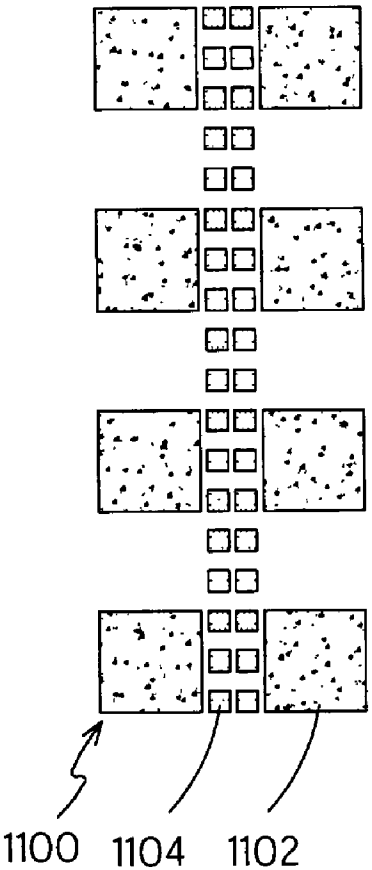

Other embodiments of an array antenna according to invention are depicted in FIGS. 11A–11C (which are top views). FIG. 11A includes an array 1100 of patch radiating elements 1102 of a first size located in a first plane and an array of patch radiating elements 1104 of a second size (smaller than the first size) located in a second plane. The first plane overlays the second plane. The planes can be parallel. The elements 1102 can radiate at a lower band than the elements 1104, e.g., $f_{1104}=5(f_{1102})$. The elements 1102 and 1104 can have a square configuration, making it possible for each to radiate two different polarizations, e.g., +/−45° or horizontal/vertical. Individual radiating elements 1102 are substantially interspersed with respect to, but substantially do not overlap, individual radiating elements 1104.

FIG. 11B depicts an array 1110 that has larger patch elements 1102 but different smaller patch elements 1112 (that can be square in configuration). Similarly, the elements 1102 can radiate at a lower band than the elements 1104, e.g., $f_{1110}=3(f_{1102})$. Also similarly, the elements 1102 can radiate two different polarizations. Individual radiating elements 1102 are substantially interspersed with respect to, but substantially do not overlap, individual radiating elements 1112.

FIG. 11C depicts an array 1120 of larger patch elements 1122 and smaller patch elements 1124. The elements 1122 can be rectangular, which restricts their radiation to single polarization, e.g., vertical. The elements 1124 can be square in configuration. Similarly, the elements 1122 can radiate at a lower band than the elements 1124, e.g., $f_{1124}=2*(f_{1122})$. Also similarly, the elements 1102 can radiate two different polarizations. Individual radiating elements 1122 are substantially interspersed with respect to, but substantially do not overlap, individual radiating elements 1124.

The cross shapes of FIGS. 1A, 2, 3 and 8–10 are rectangular. The arms have substantially the same width and length. In each of the crosses according to the disclosed embodiments, the arms of the cross intersect substantially 90°.

As an alternative configuration for the higher frequency radiating elements, e.g., 131–134, instead of squares, the radiating elements could be crosses, e.g., rectangular crosses or bow tie crosses.

Other shapes for the lower frequency element could be used, e.g., a three-pointed star (where a cross corresponds to a four-pointed star), a five or more pointed star, a counter clockwise or clockwise swastika, etc.

As an alternative to the five layer PCB of FIG. 1C, the PCB can be embodied in a single layer. An advantage of the five-layer PCB 158 over a single-layer PCB is that the five-layer PCB 158 is much less complex.

The invention may be embodied in other forms without departing from its spirit and essential characteristics. The described embodiments are to be considered only non-limiting examples of the invention. The scope of the invention is to be measured by the appended claims. All changes which come within the meaning and equivalency of the claims are to be embraced within their scope.

We claim:

1. An antenna arrangement comprising:

an array of antenna structures, each antenna structure including, a first radiating element to radiate at a first band;

at least one second radiating element to radiate at a second band; and a frame supporting the first and second radiating elements such that the first and second radiating elements are disposed in different planes, the first and second radiating elements are substantially non-overlapping, wherein the first radiating element is a cross that defines four quadrants of free space;

the second radiating element is a square; and the frame supports the second radiating element beneath one of the four quadrants of free space.

2. The arrangement of claim 1, wherein the frame supports the first and second radiating elements such that the first and second radiating elements are substantially non-overlapping in a direction perpendicular to the planes in which the first and second radiating elements are disposed.

3. The arrangement of claim 1, wherein each first radiating element includes a patch radiating element of a first size and each second radiating element is a patch radiating element of a second size.

4. The arrangement of claim 1, further comprising:

a feeder network for supplying a first band signal to the first radiating elements and at least a second band signal to the second radiating elements, the first band signal being lower than the second band signal.

5. The arrangement of claim 4, wherein the frame supports the first and second radiating elements such that the first radiating element is disposed further from the feeder network than the second radiating element.

6. The arrangement of claim 1, wherein the different planes are substantially parallel.

7. A multiple band antenna, comprising:

a first radiating element to radiate at a first band;

at least one second radiating element to radiate at a second band; and a frame supporting the first and second radiating elements such that the first and second radiating elements are disposed in different parallel planes; wherein the first radiating element is a cross that defines four quadrants of free space;

the second radiating element is a square; and the frame supports the second radiating element beneath one of the four quadrants of free space.

8. The antenna of claim 7, wherein at least one of the first and second radiating elements radiates in at least two polarizations.

9. The antenna of claim 7, wherein the frame supports the first and second radiating elements such that the first and second radiating elements are substantially non-overlapping in a direction perpendicular to the planes in which the first and second radiating elements are disposed.

10. The antenna of claim 9, wherein the first radiating element has a first pattern; and the second radiating element has a second pattern, the second pattern having a portion that is complementary to a portion of the first radiating element.

11. The antenna of claim 7, further comprising:

a feeder network for supplying a first band signal to the first radiating element and at least a second band signal to the second radiating elements, the first band signal being lower than the second band signal.

12. The antenna of claim 11, wherein the frame supports the first and second radiating elements such that the first radiating element is disposed further from the feeder network than the second radiating element.

* * * * *